United States Patent [19]

Hashimoto et al.

[11] Patent Number: 4,706,288

[45] Date of Patent: Nov. 10, 1987

[54] SPEECH SYNTHESIZER OUTPUT DEVICE

[75] Inventors: Shintaro Hashimoto, Ikoma; Akitaka Morita, Nara; Hiroshi Tsuda, Uji, all of Japan

[73] Assignee: Sharp Kabushiki Kaisha, Osaka, Japan

[21] Appl. No.: 838,871

[22] Filed: Mar. 10, 1986

Related U.S. Application Data

[63] Continuation of Ser. No. 236,519, Feb. 20, 1981, abandoned.

[30] Foreign Application Priority Data

Feb. 22, 1980 [JP] Japan ..... 55-21802

[51] Int. Cl.[4] ..... G10L 5/00

[52] U.S. Cl. ..... 381/51; 364/513.5; 368/63

[58] Field of Search ..... 381/51-53; 364/706, 709, 710, 513, 513.5; 368/63, 107, 109

[56] References Cited

U.S. PATENT DOCUMENTS

| | | | |
|---|---|---|---|
| 3,632,880 | 1/1972 | Goldshein | 368/63 |
| 4,016,540 | 4/1977 | Hyatt | 179/1 SM |
| 4,177,520 | 12/1979 | Meff | 364/710 |
| 4,246,650 | 1/1981 | Moritani et al. | 368/109 |
| 4,301,511 | 11/1981 | Shimuzu et al. | 364/709 |

*Primary Examiner*—E. S. Matt Kemeny

*Attorney, Agent, or Firm*—Birch, Stewart, Kolasch & Birch

[57] ABSTRACT

Repeated announcements by a talking timepiece are selectable in two modes: predetermined intervals selected by a selector switch, or arbitrary intervals selected by a keyboard.

3 Claims, 3 Drawing Figures

SPEECH SYNTHESIZER OUTPUT DEVICE

This application is a continuation of application Ser. No. 236,519 filed on Feb. 20, 1981 now abandoned.

BACKGROUND OF THE INVENTION

This invention relates to a speech synthesizer output device and more particularly to a speech synthesizer output device suited for use in timepieces for providing an audible indication of the interval of repeated announcements.

In the conventional electronic apparatus with an audible output device such as a talking timepiece or a combined talking calculator and timepiece, a way to confirm settings of the intervals of annoucements is, for example, to provide a slide switch or to display information indicative of the intervals of annoucements on a display panel. However, since both methods rely on the human's sense of sight, it is very difficult to confirm visually the settings in the dark. Furthermore, these methods leave the choice of confirmations to the users and thus often provide undesirable or erroneous annoucements if the interval settings are wrong or of no interest to the users.

OBJECTS AND SUMMARY OF THE INVENTION

Accordingly, it is an object of the present invention to provide a speech synthesizer output device which is capable of providing an audible indication of the interval of repeated annoucements.

The present invention is most desirably used with electronic apparatus using a speech synthesizer output device, for example, talking timepieces which provide audible announcements of certain information at a preset time interval.

Features of the present invention are summarized as follows.

(a) The interval of announcements is audibly announced in the form of a full message such as "this machine announces information every 1 hour 35 minutes".

(b) The interval of announcements is selectable at the option of the user. For example, there is provided a selector (KA) for selecting the interval of announcements (e.g., 1 minute, 5 minutes, 10 minutes, 1 hour).

(c) An audible indication of the interval of announcements is delivered upon depression of an automatic annoucement key (KS). In addition, updated time of the day is announced upon depression of the automatic announcement key (KS).

(d) The interval of announcements is audibly indicated upon depression of a sound confirm key (KK) whenever desired.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
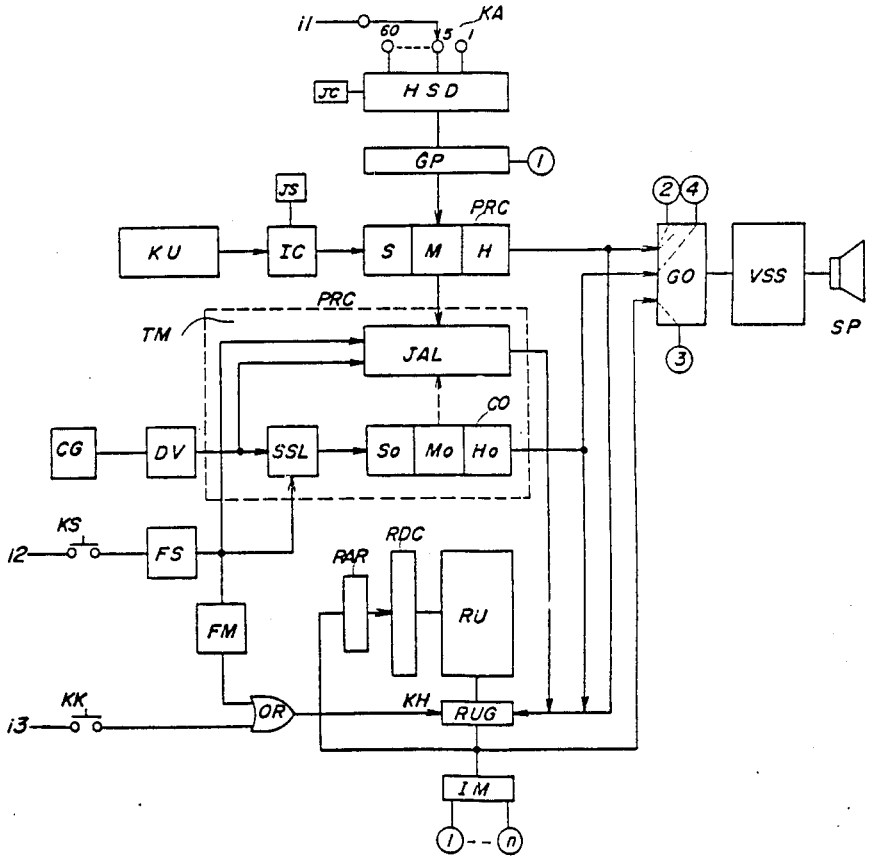
FIG. 1 is a block diagram of a talking timepiece with an audible output device according to an embodiment of the present invention.

Referring now to FIG. 1, there is illustrated a block diagram of an embodiment of the present invention. A selector KA is provided to select the interval of annoucements in steps (e.g., 1 minute, 5 minutes, 10 minutes and 60 minutes) and typically comprises a conventional slide switch disposed on the body of the timepiece. The switch KA is supplied with a high level signal i1. A decoder HSD is provided to convert an interval setting by the selector KA into numerical data typically in hours, minutes and seconds corresponding to the selected position of the selector KA.

There is further provided a decision circuit JC for deciding if the selector KA has been switched, a gate circuit GP closed upon the development of microinstruction ①, a register PRC wherein a desired interval of annoucements is presettable, a hours register segment H, a minutes register segment M and a seconds register segment S.

A keyboard KU is used for introduction of annoucement intervals and typically comprises an hour (H) key, a minute (M) key and a second (S) key, digit keys 0–9 and function keys. For example, 10 minutes are presettable as the interval of annoucements upon depressions of the keys "1", "0" and "M".

The timepiece further includes a key input control circuit IC and a decision circuit JS for deciding if the setting by the keyboard KU loaded into register PRC is numerical information other than "0".

When it is desirable to load the interval of annoucements into the preset register, either input via the selector KA or input via the keyboard KU is given priority.

A clock generator CG is connected to a divider DV to form a timekeeping circuit. A control circuit SSL is adapted to control inputs to a timer counter CO. The key KS is used as the automatic annoucement key as stated previously. A flip flop FS is set upon depression of the key KS. A pulse generator FM generates pulses in response to the output of the flip flop FS. The key KK serves as the confirm key for confirming the interval settings. An OR gate OR is switched ON in response to depression of either key KS or KK. The timer counter CO counts the clock pulses from the clock generator CG. Counter CO includes an hours counter $H_0$, a minutes counter $M_0$ and a seconds counter $S_0$.

An announcement timing circuit JAL decides when to deliver annoucements, based on the contents of the preset register PRC and the timer counter CO and performs two kinds of operations as follows upon depression of the key KS. First, JAL can store the contents of the preset register PRC or information indicative of the interval of announcements. Such information may be decremented each time the clock pulse is received from the clock generator CG. When the numerical value of the contents of the JAL drops to zero, the count of the timer counter CO is audibly indicated in the form of synthesizied human voices. In other words, the interval of annoucements stored in the register PRC is audibly annouced in the form of synthesized sounds. (see TM in FIG. 1). The second operation is carried out so that the interval setting in the register PRC is compared with the updated time of the day kept in the timer counter CO and an output is provided for an instruction selection gate RUG if the both agree. The agreement between the interval of annoucements in the register PRC and information in a specific location of the timer counter CO is determined as follows.

| | H (hours) | M (minutes) | S (seconds) |
|---|---|---|---|
| Interval of | "00" | "10" | "00" |
| annoucement (PRC) | $H_0$ | $M_0$ | $S_0$ |
| Update time (CO) | "12" | "10" | 00 |
| Update time (CO) | 12 | 20 | 00 |
| Update time (CO) | 12 | 30 | 00 |
| Update time (CO) | 12 | 40 | 00 |

Figure 2:
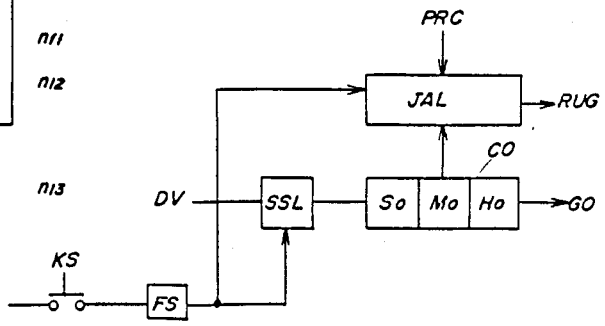
FIG. 2 is a block diagram of another embodiment of the present invention.

In other words, if the minutes position (i.e., "0") of the minutes segment M of the register PRC agrees with "0" in the minutes position of the minutes segment ($M_0$) of the counter CO, then the updated time of the day is audibly indicated in the form of synthesized sounds. (see FIG. 2).

It is noted that the instruction selection gate is labeled RUG and an instruction memory for storing word-related code data or a program memory is labeled RU. There is further provided an address register RAR, an address decoder RDC, an input gate GO to a voice synthesizer circuit VSS and a loud speaker SP.

Figure 3:
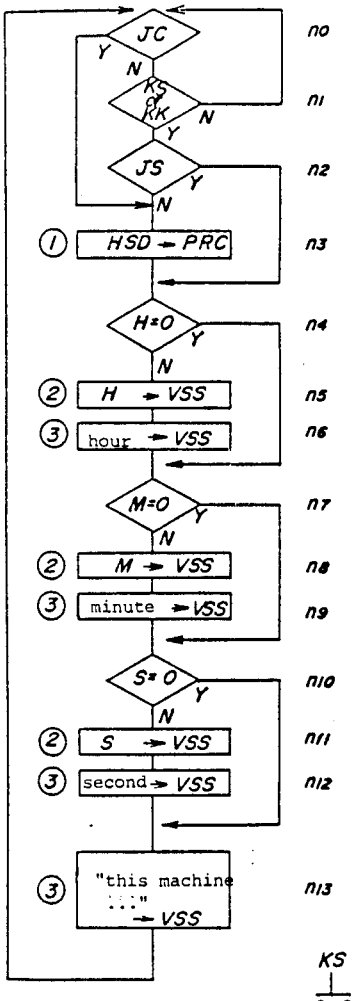
FIG. 3 is a flow chart for explanation of the operation of the embodiment of FIG. 1.

Operation of the embodiment of FIG. 1 will now be described with reference to a flow chart of FIG. 3.

An audible indication of "the interval of annoucements" according to the present invention is provided in three situations as follows:

(i) when the selector (KA) for selecting "the interval of announcements" (e.g., 1 minute, 5 minutes, 10 minutes, 60 minutes, etc.) is switched, (ii) when the key KS is depressed for providing an audible indication of "the interval of annoncements", and (iii) when the key KK is depressed for confirming "the interval of annoucements".

The decision circuit JC in the step $n_0$ decides if the announcement interval selector KA has been switched. A YES answer leads to the step $n_3$ and the NO answer leads to the step $n_1$ which senses if the key KS or KK has been depressed. The step $n_2$ senses if any numerical information other than "0" has been introduced via the keyboard KU. The step $n_3$ develops microinstruction ① and unloads the output of the decoder HSD indicative of numerical information as to the input via the interval selector KA into the preset register PRC via the gate GP. For example, if the setting by the selector KA is "1 hour interval", then the output of the decoder HSD supplies "01", "00" and "00" to the hours segment (H), minutes segment (M) and seconds segment (S) of the preset register PRC. Further, if the setting is "30 seconds", then "00", "00" and "30" are respectively supplied to those segments. The steps $n_4$ to $n_{12}$ are to provide an audible indication of updated time information such as "it's XX hours XX minutes XX seconds". The steps $n_4$, $n_7$ and $n_{10}$ decide if information in the hours (H), minutes (M) and seconds (S) segments, respectively, of the preset register PRC is "0". If any of such information is zero, the timepiece proceeds with the succeeding steps. The steps $n_5$, $n_8$ and $n_{11}$ develop microinstruction ② and transfer information in the hours (H), minutes (M) and seconds (S) segments, respectively, of the preset register PRC into the voice synthesizer circuit VSS via the gate GO. The steps $n_6$, $n_9$ and $n_{12}$ transfer linguistic information such as the sounds "hours", "minutes", and "seconds" to the voice synthesizer circuit VSS and develop microinstruction ③ for transferring the word-related code data stored in the program memory RU into the voice synthesizer circuit VSS via the gate GO. The step $n_{13}$ is one which delivers linguistic information indicating that the audible indication being provided is information as to "the interval of annoucements", for example, a statement that "this machine announces information every XX" in a like manner as in the step $n_6$. After execution of the step $n_{13}$ the cycle begins again at step $n_0$ to thereby complete the operational sequence,. Therefore, if "1 hour 35 minutes" is preset in the hours (H), minutes (M) and seconds (S) segments of the preset register PRC and the key KS is depressed for automatically providing an audible indication of "the interval of annoucements", the device will provide an audible message "this machine announces information every 1 hour and 35 minutes".

When the interval selector KA is switched, information related to "the interval of annoucements" is converted into code information via the decoder HSD and stored in the preset register PRC. The contents of the preset register are sequentially transferred to the voice synthesizer circuit VSS. The synthesized sounds including the sounds "hours", "minutes" and "seconds" are provided via the voice synthesizer circuit VSS pursuant to a stored program retrieved from the program memory RU storing the word-related code data necessary for provision of audible indications of a variety of various time information including updated time.

Upon depression of the key KS,JAL temporarily stores the interval information initially stored in the preset register PRC and starts decrementing in response to the output of the divider DV, whereas the count in timer counter CO increases. When the JAL circuit decrements in this manner and reaches a specific value, typically "0", that is when the count of the timer counter CO reaches the interval setting in the preset register PRC, the output of the JAL circuit is fed to the instruction selection gate RUG so that the interval of announcements is indicated in the form of synthesized sounds. Similarly, the count of the timer counter can be indicated in the form of audible sounds in the same manner as in audibly indicating the contents of the register PRC. (see FIG. 1).

In the case where the counter updates time information, JAL compares the count of the register PRC with that of the timer counter CO and permits delivering an audible indication of the updated time information in the counter CO according to the interval of annoucement stored in the register PRC.

Since in the foregoing even though the interval selector is switched in operation the register PRC stores the new setting, the new setting can be audibly indicated after the elapse of a predetermined period of time.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined timepiece and audible output device comprising:

timekeeping means;

speech synthesizer output means;

first switching means for selecting and setting at least one predetermined time interval for audible announcements by said speech synthesizer output means;

keyboard input means for freely selecting and setting any desired time interval for audible announcements by said speech synthesizer output means;

control circuit means connected to said timekeeping means, speech synthesizer output means, first switching means and keyboard input means;

said control circuit means being automatically responsive to actuation of said first switching means for actuating said speech synthesizer output means to audibly output the time interval set by said first switching means; and selectively actuable announcement switch means connected to said control circuit means for selectively actuating said speech synthesizer output means to audibly output the time interval set by said first switching means or by said keyboard input means.

2. A timepiece and audible output device according to claim 1 further comprising means for adding a distinguishing message to said audible output of said set interval in response to actuation of said announcement switch means.

3. A timepiece and audible output device as in claim 1 wherein said first switching means comprises a selector switch having plural setting positions for selectively setting one of a plurality of predetermined time intervals.

* * * * *